United States Patent [19]

Takahashi

[11] 4,308,778

[45] Jan. 5, 1982

[54] SLICER

[75] Inventor: Katsushi Takahashi, Asaka, Japan

[73] Assignee: Height, Inc., Matsudo, Japan

[21] Appl. No.: 154,079

[22] Filed: May 28, 1980

[51] Int. Cl.[3] ..... B26D 1/50

[52] U.S. Cl. ..... 83/751

[58] Field of Search ..... 83/751, 621, 427, 425.2

[56] References Cited

U.S. PATENT DOCUMENTS

| | | | |
|---|---|---|---|
| 1,976,331 | 10/1934 | Criner | 83/751 |
| 1,995,096 | 3/1935 | Fritz | 83/751 |
| 2,095,620 | 10/1937 | Tuthill | 83/751 |
| 2,528,853 | 11/1950 | Brustowsky | 83/751 |
| 3,628,581 | 12/1971 | Takahashi | 83/621 |

*Primary Examiner*—Jimmy C. Peters

*Attorney, Agent, or Firm*—Wenderoth, Lind & Ponack

[57] ABSTRACT

An improvement on a slicer of the type, for slicing foodstuff into slices of uniform size by causing one group of knife blades supported side by side on respective blade holders to be reciprocated within grooves defined between blade holders having the other group of knife blades supported side by side thereon, wherein all hook members are vertically mounted on the respective blade holders so as to be in the extension of each knife blade.

3 Claims, 14 Drawing Figures

Fig. 2a
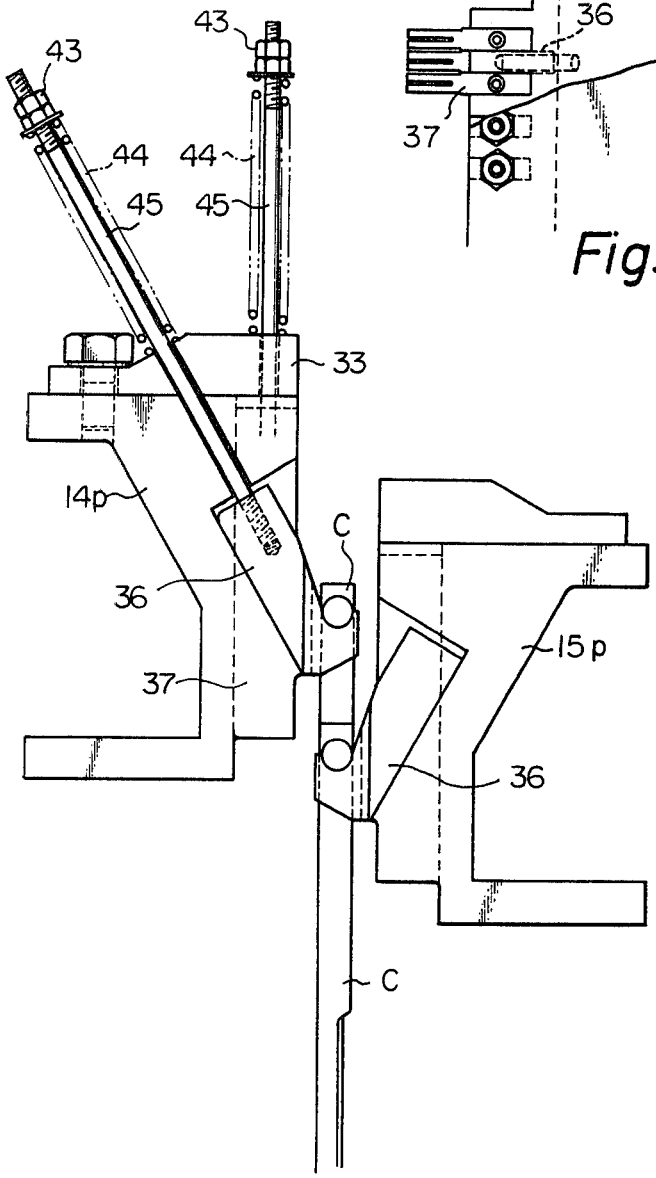
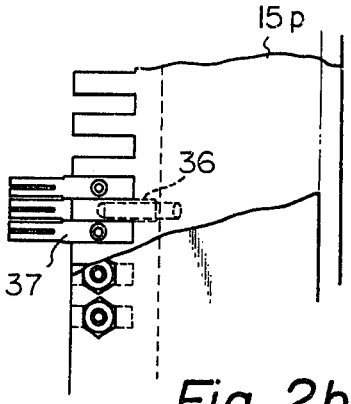
Fig. 2b

SLICER

BACKGROUND OF THE INVENTION

This invention relates to a slicer having a very small space between two adjoining knife blades for slicing foodstuff, such as ham, bacon, cheese, meat, bread and the like into thin slices.

In conventional slicers having a very small space between adjoining knife blades which are secured in side by side relationship by a pair of blade holders which move reciprocally for slicing the aforementioned foodstuff, there are two difficulties in slicing such foodstuff into very thin slices. One difficulty is that the hook members for holding the knife blades on the blade holders must have individual resilient means such as a coil spring for providing even tension on an individual knife blade. This results in the minimum spacing between said adjoining knife blades being limited to a size larger than half of the diameter of said coil springs, so that an extremely small space, for example, 2.5 mm, is not possible. Another difficulty is that the hook members on the blade holder must pass between the hook members on the other blade holder during reciprocal moving, so the minimum space between said adjoining knife blades is limited to a space larger than the thickness of said hook members. Concerning the support members, which are fixedly mounted on the lower portion of the blade holder respectively and have a plurality of supporting parts for supporting the lower portions of the knife blades and have a plurality of grooves between the supporting parts for allowing the supporting parts of the other blade to pass, said minimum space being limited to a space larger than the width of the supporting parts. For these reasons, in slicing foodstuff into very thin slices with a conventional slicer, the knife blades can't be pulled with enough tension to slice the foodstuff into even thickness slices due to weak resilient means and thin hook means and weak supporting parts.

My U.S. Pat. No. 3,628,581 granted on Dec. 21, 1971 discloses a machine useful for slicing the aforementioned foodstuff, which is adapted to support and secure the knife blades positively, making it possible to readily slice the foodstuff into thin slices of desired uniform thickness at a high speed.

The slicer disclosed therein has two groups of knife blades secured in side-by-side relationship by a pair of blade holders, each group comprising a plurality of blades which move reciprocally to cut foodstuff into slices. Each pair of blade holders secures one group of knife blades and is provided with a groove between each blade of the supported group through which a blade of the other group of knife blades passes to define an opening between adjacent blades.

In the slicers described in my U.S. Pat. No. 3,628,501, however, a great deal of complexity is involved in construction and assembly when the hook member is mounted on the blade holder since the vertical and diagonal hook members are alternately interconnected with each other. Further, when the blades are each pulled by the same size resilient means, the tension on the blades as set on the diagonal hooks is different from that on the blades on the vertical hooks, because the direction of the clamping force of the diagonal hooks is different from that of the vertical hooks. Such a blade assembly requires a complex adjustment to achieve even blade tension. Otherwise it is difficult to slice the foodstuff into even thickness slices due to the uneven blade tension.

Further, when the length of each blade from holding pin to holding pin is slightly different, the edge of each knife blade is not arranged in a straight line. This causes difficulty in slicing in even thicknesses.

SUMMARY OF THE INVENTION

It is, therefore, a primary object of the present invention to solve the aforementioned difficulties encountered in the prior art slicers. One feature of the present invention is to provide a slicer of the type having a blade support arrangement wherein all the hook members are fixed vertically, viz., on the line which is an extension of the knife blades thereby avoiding the need for a complex structure and adjustment and arrangement of the edges of the knife blades.

Another feature of the present invention is to provide a slicer which has two reciprocating blade holders, and the hook members on one blade holder do not pass through grooves between the hook members and the supporting parts of the supporting members on the other blade holders, and the supporting parts of the supporting members at the one blade do not pass through the grooves between the supporting parts of the supporting members on the other blade holder.

BRIEF DESCRIPTION OF THE DRAWINGS

A preferred embodiment of the present invention will be described in detail hereinafter by way of example with reference to the accompanying drawings, in which:

FIG. 2*a* is a partial side view of the conventional blade holder of the slicer of my U.S. Pat. No. 3,628,581 and FIG. 2*b* is a partial top view of the conventional blade holder;

DESCRIPTION OF THE PREFERRED EMBODIMENTS

Figure 1:
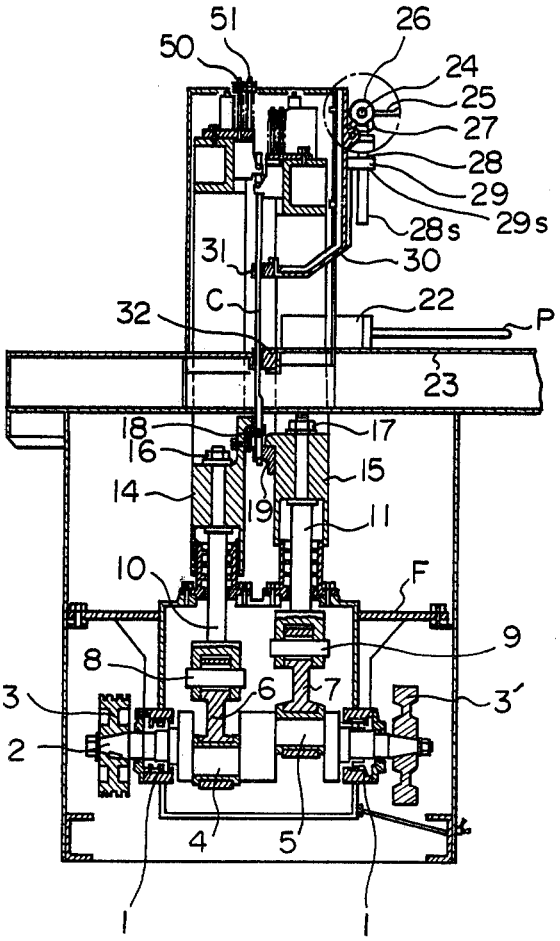
FIG. 1 is a vertical sectional view showing the general arrangement of a slicer according to the present invention.

Now, referring to FIG. 1, a crank shaft 2 is rotatably supported on bearings 1 mounted on a lower part of frame F. A driving wheel 3 having belts (not shown) passing thereover is mounted on the crank shaft 2 at the left end thereof and a flywheel 3' is mounted on the crank shaft at the right end thereof. A pair of connecting rods 6 and 7 have their lower ends rotatably fitted over the crank pins 4 and 5 respectively, formed integrally with the crank shaft 2. The pair of connecting rods 6 and 7 have their upper ends connected to lower ends of reciprocating rods 10 and 11, respectively, by means of pivot pins 8 and 9. The reciprocating rods 10 and 11 are connected to blade holders 14 and 15, respectively, by reduced size portions 12 and 13 of the reciprocating rods 10 and 11 extending into bores in the blade holders 14 and 15 and nuts 16 and 17 clamping the upper ends of the reciprocating rods 10 and 11 to holders 14 and 15. Support members 18 and 19 are secured respectively to the lower portion of the blade holders 14 and 15 by means of bolts 20. A guide table 23 is adjustably mounted across the blade holders 14 and 15 and is centered relative to the latter. Foodstuff 22, such as ham, bacon, cheese and bread, is mounted on the guide table 23 and moved to the left in FIG. 1, by means of a pusher P, which is movable horizontally along the upper surface of the guide table 23, and will be sliced by means of the numerous knife blades C which are reciprocated vertically as described in detail hereinafter. The pusher P may be moved manually or mechanically by means of a suitable link mechanism (not shown) at a predetermined height above the guide table 23. A shaft 24 is provided on one end with a handle 25 and a bevel gear 26 on the other end. Another bevel gear 27, meshing with the bevel gear 26 and fixedly mounted on a threaded rod 28, is mounted on one side of a carrier member 30 (the right side in FIG. 1) which is moved vertically toward and away from the guide table 23. A knife blade guide member 31 is fixedly mounted on the other side of the carrier member 30 (the left side in FIG. 1) and another knife blade guide member 32 is fixedly mounted on the guide table 23 so as to cooperate with the guide member 31. The knife blades extend slidably through the guide members, the guide members keeping all the knife blades C in a straight condition.

In the prior art shown in FIGS. 2*a* and 2*b*, the blade holders 14 and 15 are each adapted to hold vertical hook members 37 and diagonal or inclined hook members 36 alternately arranged side by side. A supporting rod 45 extends from each of the hook members at the upper end thereof and is secured thereto by screw threads or the like. The rod 45 is provided at its upper end with a coil spring 44 therearound. The coil spring 44 is interposed between a connector 33 and a nut 43 threaded onto the upper end of the rod 45 to urge the hook member 36 or 37 upwardly under the force of the compressed spring 44. In this manner, tensile force is applied to the blade C to hold it straight. With such an arrangement for mounting the hook members, the aforementioned disadvantages and defects are present.

Figure 6A:
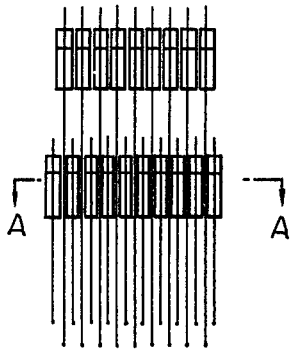
FIG. 6*a* is a schematic front view of juxtaposed knife blades in the slicer according to the present invention and FIG. 6*b* is a partial cross-sectional view of the hook members and the blades taken along the line A—A in FIG. 6*a;*
Figure 6B:
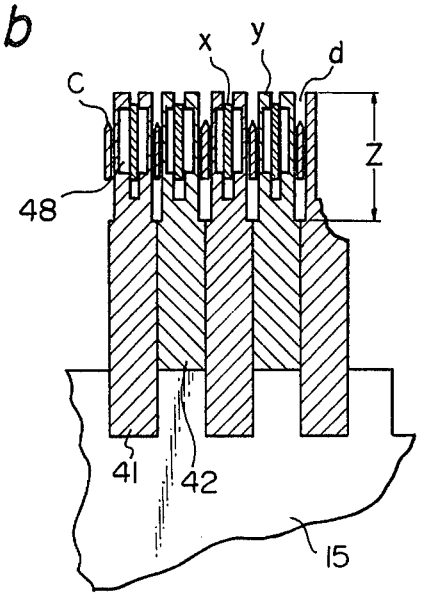
Figure 7A:
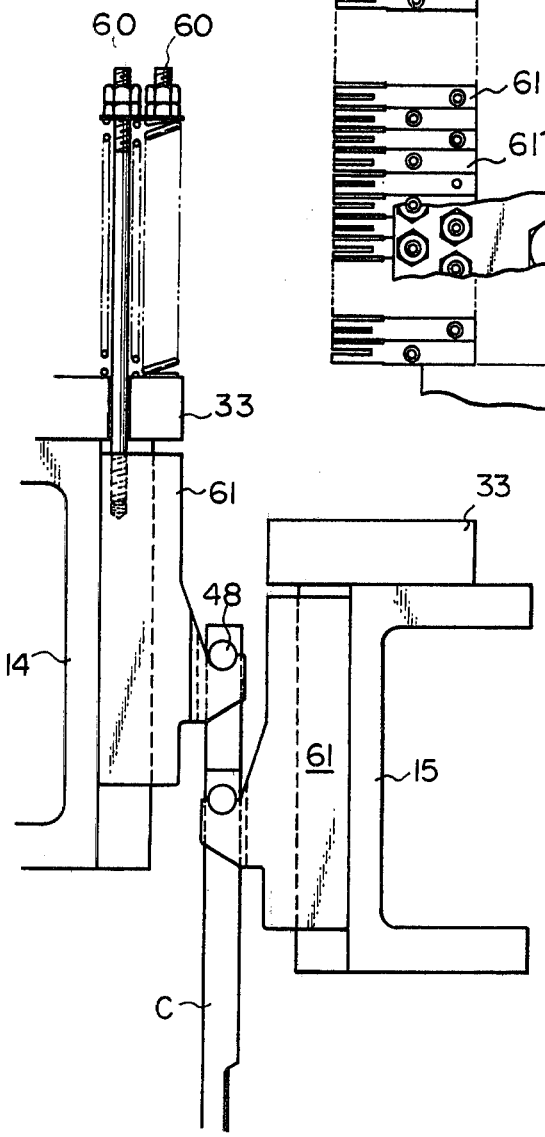
FIGS. 7*a* and 7*b* are upper side and top views respectively of another type of blade holder according to the present invention.
Figure 7B:
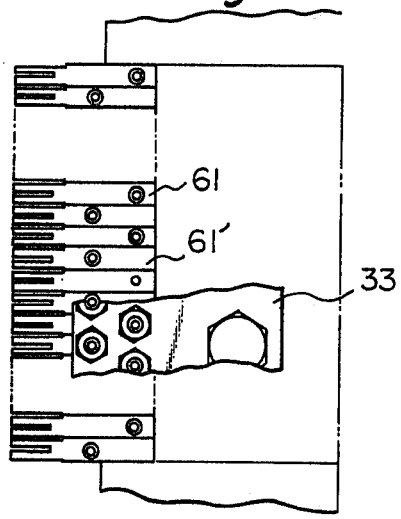
Figure 8:
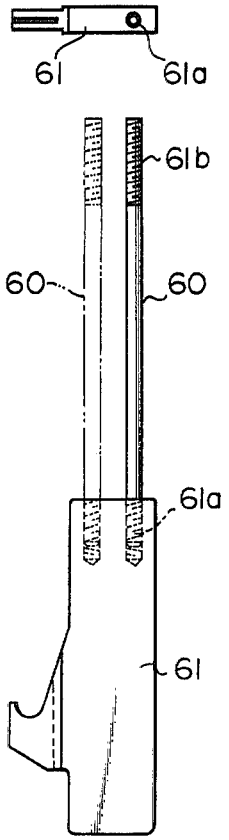
FIG. 8 is a top and side view of the hook member shown in FIGS. 7*a* and 7*b.
Figure 9:
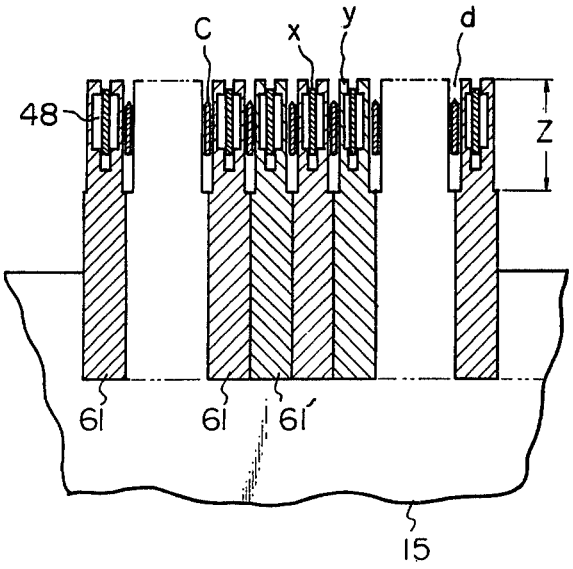
* and FIG. 9 is a partial cross-sectional view of juxtaposed hook members shown in FIG. 8 and blades.

Referring to FIGS. 3, 4*b*, 5*a*, 5*b*, 6*a* and 6*b*, the arrangement for mounting the blade holders 14 and 15 for the knife blades C on the hook members 41 and 42 is clearly shown. Since the manner in which the knife blades are secured on the blade holders is similar throughout the device, only one holder 15 will be described for the purpose of convenience. A connector 33 which includes holes m to receive supporting rods 50 or 51 therein is secured to the blade holder 15 at one end thereof by means of a clamping member 34 such as a bolt. The hook members 41 and 42 are held by the connector 33 against the blade holders 14 and 15. All the hook members 41 and 42 are held vertically with respect to the blade holders so as to engage the pins 48 mounted on the upper ends of the strip type blades C. In this instance, the hook members 41 and the other hook members 42 are alternately disposed side by side so as to maintain the blades C in a straight line with the knife edges in alignment therewith (see FIGS. 4*a* and 4*b* ). More specifically, as best shown in FIG. 6*b*, each of the wider and narrower hook members 41 and 42 is provided at its front side with blade supporting forked ends y which define a channel x and which are adapted to engage the pins 48 thereon. These forked ends y of the hook members are configured to provide grooves d therebetween when they are juxtaposed with each other in a straight line. These grooves d of depth of z are adapted to receive therein the reciprocating knife blades C held by the hook members and other blade holders (see FIG. 4*a*). Each of the wider hook members 41 has at its upper end a threaded hole 41*a* into which a thread 50*a* of the supporting rod 50 is screwed, and each of the narrower hook members 42 has at its upper end a threaded hole 42*a* into which a thread 51*a* of the supporting rod 51 is threaded. The other ends of the supporting rods 50 and 51 are threaded at 50*b* and 51*b* to threadedly receive stop nuts 43 thereon.

Figure 3:
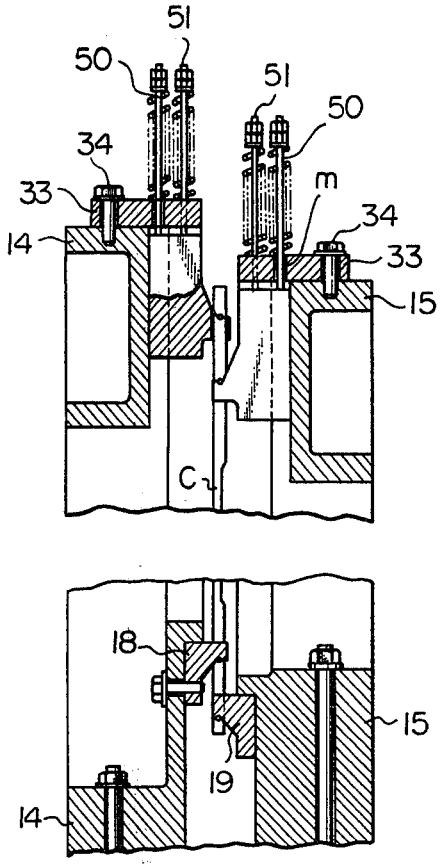
FIG. 3 is a vertical sectional view on an enlarged scale showing the support members and hook members for the knife blades.
Figure 4A:
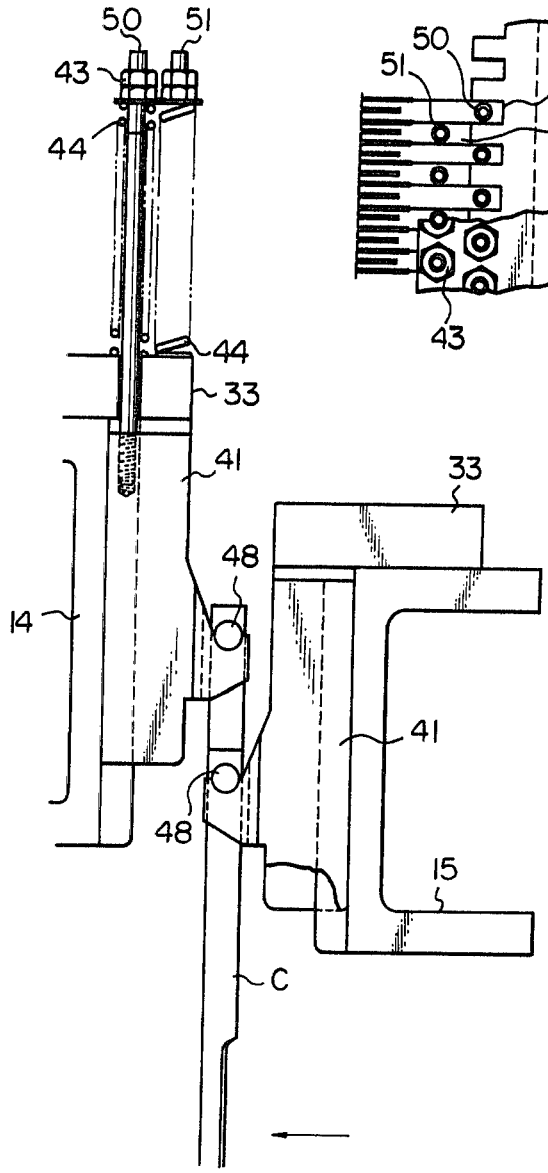
FIGS. 4*a* and 4*b* are a partial side and top views respectively of the blade holder of the present invention.
Figure 4B:
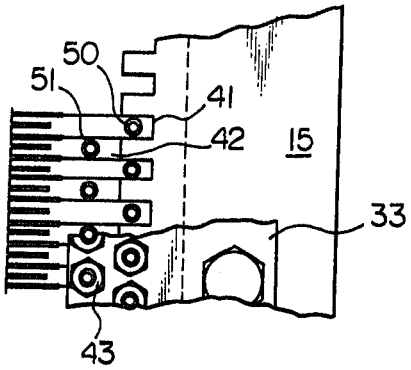
Figure 5A:
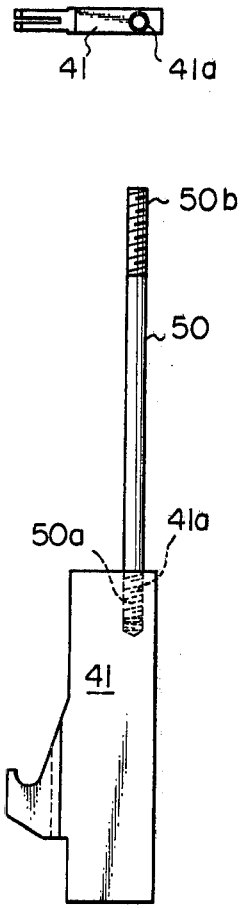
FIGS. 5*a* and 5*b* are top and side views of different types of hook members which can be alternately combined.
Figure 5B:
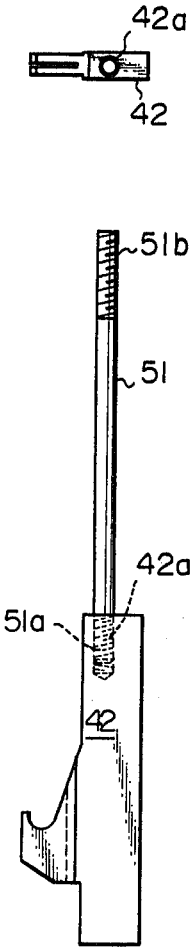

As shown in FIGS. 4*a* and 4*b*, each of the wider hook members has the threaded hold 41*a* at a position remote from the knife blade C and each of the narrower hook members has the threaded hole 42*a* at a position close to the knife blade C and the connector 33 has the holes at positions corresponding to the said threaded holes 41*a* and 42*a* and the rods 50 and 51. When the hook members 41 and 42 are arranged side by side with each other, said rods 50 and 51 are in a zigzag pattern (as shown in FIG. 4*b*). Therefore, the coil springs do not touch each other, so that larger diameter coil springs can be used to give greater tension to the knife blades "C." As clearly shown in FIGS. 6*a* and 6*b*, width of the groove d is very narrow for a slicer for thin slicing of the foodstuff, so each of the grooves d can not allow the hook members on the opposite blade holder to pass therethrough, as in the conventional reciprocating slicer, but can only permit the knife blade "C" of the opposite blade holder to pass therethrough. In FIGS. 1 and 3, the left side blade holder 14 is in the highest position and right side blade holder 15 is in the lowest position during the entire reciprocating motion. As clearly illustrated in FIG. 4*a*, all the blades C cut foodstuff 22, such as ham, bacon, cheese, bread, meat or the like urged by the pusher from the direction of the arrow, into slices.

A modified form of the hook member for the slicer of the present invention is shown in FIGS. 7*a*, 7*b*, 8, and 9, in which the hook members 61 and 61' have the same width and are alternately disposed side by side in a straight line. The hook members in the first and second embodiments differ in width. That is, the hook members 41 and 42 in the first embodiment differ in width from one another whereas the hook members 61 and 61' in the second embodiment have the same width but the supporting rods are alternately offset. The threads 61*a* and 61*b* on rods 60 perform the same functions as the threads 50*a* and 50*b*. In both embodiments, the hook members as well as the supporting rods are vertically disposed in the same direction as the blades C.

In operation, a lump of foodstuff 22 is placed on the guide table 23 and will be pushed forward to the cutting edge C of the knife blades, extending vertically side by side, by means of a pusher P, which is moved to the left in FIG. 1, and the foodstuff is held against vertical motion between the guide members 31 and 32. The prime mover drives the crank shaft 2 through driving wheel 3. Accordingly, the blade holders 14 and 15 are reciprocated simultaneously and in opposite directions to each other by action of the connecting rods 6 and 7 and the reciprocating rods 10 and 11, while being maintained in parallel side by side condition, thereby causing one group of knife blades C and another group of knife blades C mounted side by side on the blade holders 14 and 15, respectively, to be reciprocated simultaneously but in opposite direction. When the foodstuff 22 is progressively pushed along the table 23 by means of the pusher P, to the left in FIG. 1, it will be sliced instantaneously by means of the groups of knife blades reciprocating in opposite directions to each other into slices of uniform thickness by means of the cutting edges C. The sliced foodstuff will have a uniform appearance. Furthermore, the slicer according to the present invention will have a spacing between two adjoining blades much smaller than that of the conventional slicer.

In addition, there will be no need of making the blade supporting portion heavy despite the very small spacing between adjoining knife blades. A number of grooves are formed between supporting members supporting the blades moving in one direction so as to accomodate the blades moving in the opposite direction. Thus, the construction of the slicer according to the present invention is not complicated, and the same construction may be used for each blade holder thereby making the assembly very simple and fast.

In case some of the blades become broken, they may be replaced very easily by releasing and engaging a few pins on the blades which are adapted to be engaged with recesses in the hook members or supporting members.

What is claimed is:

1. A slicer for making a plurality of uniform, thin slices in a single operation, comprising: a frame; first and second blade holders mounted for opposite reciprocal motion in said frame, each of said blade holders having a substantially parallel, spaced upper and lower portion; first and second groups of knife blades; means to mount said first and second groups of knife blades in said first and second blade holders, respectively, said mounting means each comprising a support member fixedly mounted on the lower portion of the corresponding blade holder and hook means for each blade in the group adjustably mounted side by side on the upper portion of the corresponding blade holders, said hook means being shaped to define a groove between each two adjacent hook means, said groove having a size to pass a knife blade, said supporting members having a blade passing grooves therein, said blade holders being mounted in said frame with the upper and lower portions of one blade holder higher than the upper and lower portions of the other blade holder and the knife blades of the group on the one blade holder passing through the groove between the hook means on the other blade holder so as to be parallel to and closely spaced from the knife blades on the other blade holder, and the knife blades on the other blade holder passing through the grooves in the supporting member of the one blade holder; and means to reciprocate said blade holders in opposite directions.

2. A slicer as claimed in claim 1 in which said hook means has supporting rods resiliently mounted on said upper portion and the rods of adjacent hook means being offset from each other, said hook means being substantially parallel with each other.

3. A slicer according to claim 1 in which said upper portion of each of said blade holders has a plurality of openings therein, and each of said hook means comprising a hook member, the supporting rod being fixed to the upper end of said hook member and extending through a corresponding opening, adjusting means connected to the other end of said rod, and resilient means mounted between said adjusting means and said blade holder and acting on said supporting rod, whereby the knife blade attached thereto is kept under constant tension.

* * * * *